US005077867A

United States Patent [19]

Messina

[11] Patent Number: 5,077,867

[45] Date of Patent: Jan. 7, 1992

[54] BELT CLASP FASTENER DEVICE

[76] Inventor: Leah G. Messina, 1210 River Oaks, Lewisville, Tex. 75028

[21] Appl. No.: 663,971

[22] Filed: Mar. 4, 1991

[51] Int. Cl.[5] ..... A44B 11/00

[52] U.S. Cl. ..... 24/182; 24/301; 24/336

[58] Field of Search ..... 24/182, 180, 265 WS, 24/71 J, 194, 196, 300, 301, 17 A, 17 B, 336; 2/322, 327, 337; 54/81

[56] References Cited

U.S. PATENT DOCUMENTS

| | | | |
|---|---|---|---|
| 374,068 | 11/1887 | Hickle | 24/182 |
| 460,447 | 9/1891 | Rosenberger | 54/81 |
| 1,113,954 | 10/1914 | Calloway | 24/300 |
| 1,285,981 | 11/1918 | Glassburn | 24/182 |
| 1,414,048 | 4/1922 | Schlutz | 2/322 |
| 2,080,058 | 5/1937 | Parry . | |
| 2,465,787 | 3/1949 | Bliek | 24/336 |
| 2,585,157 | 2/1952 | Moore . | |
| 3,034,189 | 5/1962 | Twentier | 2/322 |
| 3,069,691 | 12/1962 | Svojse . | |
| 3,331,110 | 7/1967 | Allan . | |
| 3,672,005 | 6/1972 | Barber | 24/300 |
| 4,021,890 | 5/1977 | Kurosaki | 24/301 |

*Primary Examiner*—Victor N. Sakran

*Attorney, Agent, or Firm*—Henderson & Sturm

[57] ABSTRACT

A belt clasp fastener device (10) for releasably engaging the free end (101) against the main body (102) of a belt (100). The device (10) includes an adjustable width unit (12) whose length may be varied to compensate for belts having different widths and a pair of releasable clasp unit (11) which are pivotally secured on the opposite ends of the adjustable width unit (12). The clasp units (11) will press the free end (101) against the main body (102) of the belt (100).

3 Claims, 1 Drawing Sheet

BELT CLASP FASTENER DEVICE

TECHNICAL FIELD

The present invention relates to the field of belt accessories in general, and in particular to a device for securing the loose end of a belt against the main portion of the belt in an attractive manner.

BACKGROUND ART

This invention was the subject matter of Document Disclosure Program Registration No. 254,666 which was filed in the United States Patent and Trademark Office on June 4, 1990.

As can be seen by reference to the following U.S. Pat. Nos. 2,080,058; 2,585,157; 3,069,691; and 3,331,110; the prior art is replete with myriad and diverse garment fasteners used to maintain a wide variety of garments in place on a user's person.

While all of the aforementioned prior art constructions are more than adequate for the basic purpose and function for which they have been specifically designed, these patented constructions are neither suited for, nor adapted for use to solve the problem addressed by the present invention.

Both men and women encounter this particular problem when a belt they are wearing is too long. The free end of the belt hangs loosely below the waist encircling portion of the belt, thereby producing a sloppy and unattractive appearance.

While most men's fashions provide a plurality of belt loops in close proximity to the belt buckle, many women's fashions only provide a single belt loop in the vicinity of the belt buckle. The only way to deal with this problem in the past has been to physically pin the loose end of the belt strap to the waist encircling portion of the belt.

As a consequence of the foregoing situation, there has existed a longstanding need among both men and women for a belt accessory that is not only fashionable, but functional with regard to providing simple and efficient means of releasably securing the free end of a belt. The accessory is adjustable in width to accommodate different sized belts. The provision of such a construction is a stated objective of the present invention.

DISCLOSURE OF THE INVENTION

Briefly stated, the belt clasp fastener device that forms the basis of the present invention comprises a pair of clasp units disposed on the opposite ends of an intermediate adjustable width unit. The clasp units cooperate with the ends of the adjustable width unit captively engaging the free end of a belt against the main body of the belt.

In addition, the adjustable width unit is dimensioned to be received between the user's garment and the interior surface of the main portion of the user's belt. The clasp units are provided with a decorative design and are dimensioned to extend from the interior surface of the belt to the exterior surface of the free end of the belt.

As will be explained in greater detail further on in the specification, in one form of the preferred embodiment of this invention, the adjustable width unit is designed to be relatively flexible for use with somewhat thick, rigid belt materials. In another form of the preferred embodiment, the adjustable width unit is designed to be relatively rigid for use with thin and deformable belt materials.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
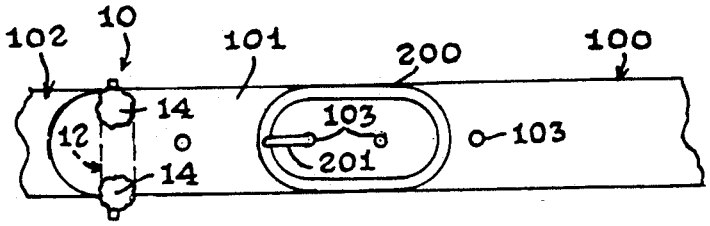
FIG. 1 is a front plan view of the belt clasp fastener device employed on a belt.

As can be seen by reference to the drawings, and in particular to FIG. 1, the belt clasp fastening device that forms the basis of the present invention is designated generally by the reference numeral (10).

Figure 2:
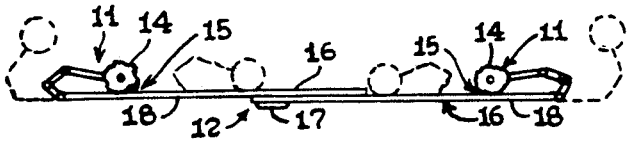
FIG. 2 is a side plan view of one version of the preferred embodiment.
Figure 5:
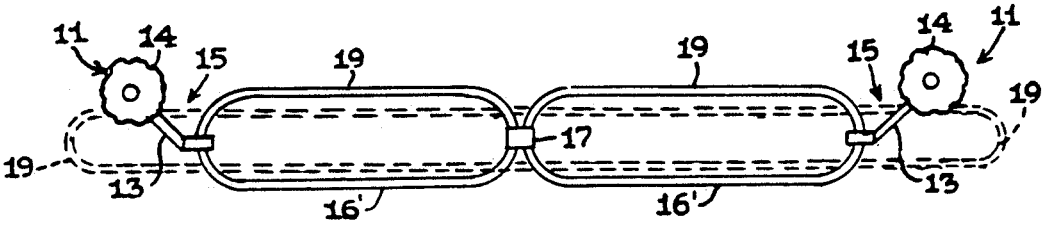
FIG. 5 is a top plan view of the second version of the preferred embodiment.

As shown in FIGS. 2 and 5, in the two versions of the preferred embodiment of this invention, the device (10) comprises in general a pair of pivoted clasp units (11) disposed on the opposite ends of an adjustable width unit (12).

In both versions of the preferred embodiment, the clasp units (11) comprise articulated clasp members (13) having enlarged decorative head elements (14) formed on their free ends. The captive ends of the articulated clasp members (13) are operatively and pivotally attached to the opposite ends of the adjustable width unit (12). In addition, each pair of clasp units (14) cooperates with the respective ends of the adjustable width unit (12) to define opposite clasp openings (15).

Figure 3:
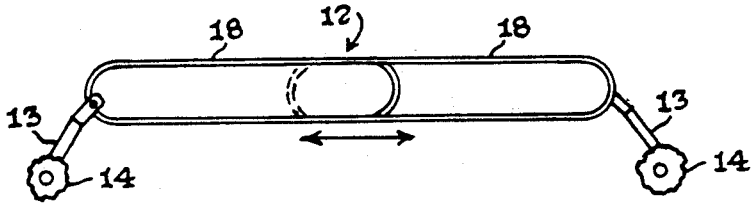
FIG. 3 is a top plan view of the embodiment of FIG. 2.

In the first version of the preferred embodiment depicted in FIGS. 2 and 3, the adjustable width unit (12) comprises two cooperating intermediate members (16). The members (16) are operatively connected together by a coupling member (17).

Furthermore, in this particular version of the invention, the intermediate members (16) are generally flat, rigid elongated elements (18). Elements (18) are slidably disposed relative to one another via the coupling member (17) to vary the effective length of the combined rigid elongated elements (18) in a well recognized fashion.

Figure 4:
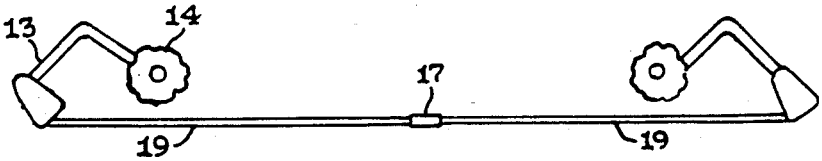
FIG. 4 is a side plan view of another version of the preferred embodiment engaged with a belt.

In the second version of the preferred embodiment depicted in FIGS. 4 and 5, the adjustable width unit (12) comprises two cooperating intermediate members (16') operatively connected together by a coupling member (17').

However, in this particular version of the invention, the intermediate members (16') are generally resilient elastic elements (19). Elements (19) are connected together by the coupling member (17) and are stretchable to vary the effective length of the adjustable width unit (12), as depicted in phantom in FIG. 5.

Turning now to FIGS. 1 and 4, it can be seen that in both versions of the preferred embodiment, the adjustable width unit (12) is dimensioned to be received between a conventional belt construction designed generally as (100) and an outer garment (not shown) worn by the user.

As shown in FIG. 1, the conventional belt construction comprises a belt member (100) having a free end (101) provided with a plurality of apertures (103) wherein the main body (102) of the belt member is provided with a buckle element (200) having a buckle post (201) which is dimensioned to be received in a selected one of the plurality of apertures (103) to secure the belt member (100) around the user's person in a well recognized fashion.

As can best be seen by reference to FIG. 4, the adjustable width unit (12) is adapted to extend across and come in contact with the inner surface of the main body (102) of the belt member (100). The clasp units (11) are adapted to extend across the thickness of both the main body (102) and the free end (101) of the belt member (100). The head elements (14) of the clasp members (13) will come into captive engagement with the outer surface of the free end (101) of the belt member (100) to hold the free end (102) in flush contact against the main body (102) of the belt member.

In this manner, the user can employ the device (10) to keep the free end (101) of the belt member (100) from either hanging loosely downwardly, or projecting outwardly from the main body of the belt member (100). In addition, the decorative appearance of the head elements (14) of the clasp members (13) further enhances the aesthetic appearance of the user.

Having thereby described the subject matter of the present invention, it should be apparent that many substitutions, modifications and variations of the present invention are possible in light of the above teachings. It is therefore to be understood that the invention as taught and described herein is only to be limited to the extent of the breadth and scope of the appended claims.

I claim:

1. A belt clasp fastener device for use in combination with: a conventional belt having a buckle attached on one end and a plurality of discrete apertures formed on the other end; and, a garment provided with a plurality of belt loops; for releasably engaging the free end of the belt against the main body of the belt; wherein, the belt clasp fastener device comprises:

an adjustable width unit including two generally thin, flat cooperating members connected together by an intermediate coupling member wherein the coupling member permits the cooperating members to be moved relative to one another to vary the effective length of the said adjustable width unit; and, a pair of inwardly facing clasp units formed on opposite ends of the adjustable width unit wherein each of the clasp units has a free end provided with an enlarged decorative head element mounted on a generally L-shaped pivoted member operatively connected to the said opposite ends of the adjustable width unit; whereby each of the decorative head elements are brought into releasable captive engagement with the exterior front surface of the free end of the belt, when the adjustable width unit is in contact with the inner surface of the main body of the belt to maintain the free end of the belt in contact with the main body of the belt.

2. The device as in claim 1 wherein the cooperating members are generally rigid elements which are slidably connected relative to one another by the coupling member to vary their combined effective length.

3. The device as in claim 1 wherein the cooperating members are generally resilient, elastic elements which are stretchable relative to one another to vary their combined effective length.

* * * * *